US006196930B1

(12) United States Patent
Aumock

(10) Patent No.: US 6,196,930 B1
(45) Date of Patent: Mar. 6, 2001

(54) EXTENSION APPARATUS FOR GOLF CLUB

(76) Inventor: Randy T. Aumock, 1159 W. Emelita Ave., Mesa, AZ (US) 85210

( * ) Notice: Subject to any disclaimer, the term of this patent is extended or adjusted under 35 U.S.C. 154(b) by 0 days.

(21) Appl. No.: 09/299,812

(22) Filed: Apr. 26, 1999

Related U.S. Application Data

(63) Continuation-in-part of application No. 08/968,038, filed on Nov. 12, 1997, now abandoned.

(51) Int. Cl.[7] ..... A63B 69/36
(52) U.S. Cl. ..... 473/206; 473/226; 473/276
(58) Field of Search ..... 473/206, 226, 473/227, 238, 266, 276, 277, 298, 299; 285/421, 400, 415, 80, 89, 249, 255

(56) References Cited

U.S. PATENT DOCUMENTS 1,968,616 * 7/1934 Oldham ..... 473/298
2,374,284 * 4/1945 Hall ..... 285/421
2,998,269 * 8/1961 Houghton ..... 285/421
3,188,086 * 6/1965 Parmley ..... 473/227
3,352,575 * 11/1967 Daspit ..... 285/421
4,595,204 * 6/1986 Patterson ..... 473/227
5,163,685 * 11/1992 Rhodes ..... 473/206
5,465,971 * 11/1995 Tischler ..... 473/276
5,679,080 * 10/1997 Finsterwald ..... 473/276
5,772,523 * 6/1998 Sheftic ..... 473/277

* cited by examiner

*Primary Examiner*—Steven Wong
(74) *Attorney, Agent, or Firm*—H. Gordon Shields

(57) ABSTRACT

Golf club extension apparatus includes a cup or socket secured to an extension, and the cup or socket receives the end of a golf club grip portion. A tapered and slotted lock ring fits over a golf club shaft and extends into the cup and about the grip to secure the extention to the grip. The lock ring includes a taper to allow the apparatus to be used with the virtually any make of golf club or to the various sizes of golf club grips. The purpose of the extension is to be used as a training aid to demonstrate to a user that the user's swing motion is either correct or incorrect. An incorrect swing motion will result in the extension whacking the user, while a proper swing motion will allow the extension to move between the user's arms and around the use's torso during the swing motion.

4 Claims, 2 Drawing Sheets

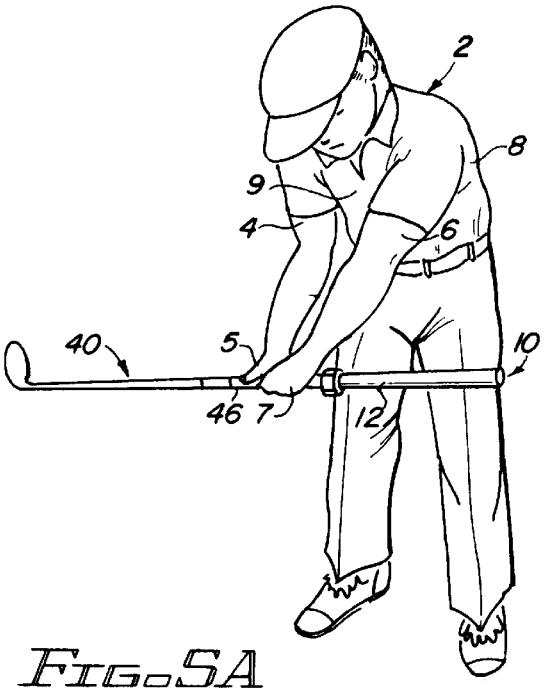
FIG. 5A
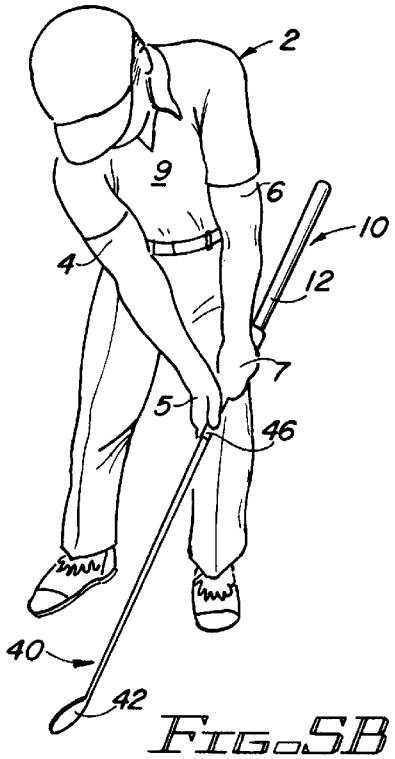
FIG. 5B
FIG. 5C
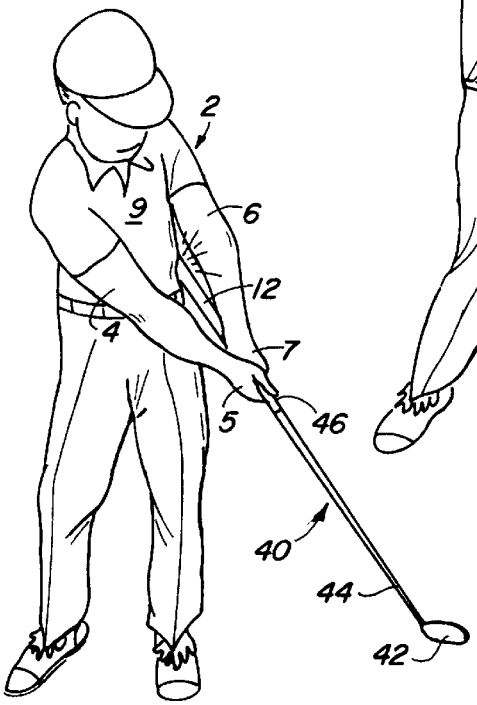
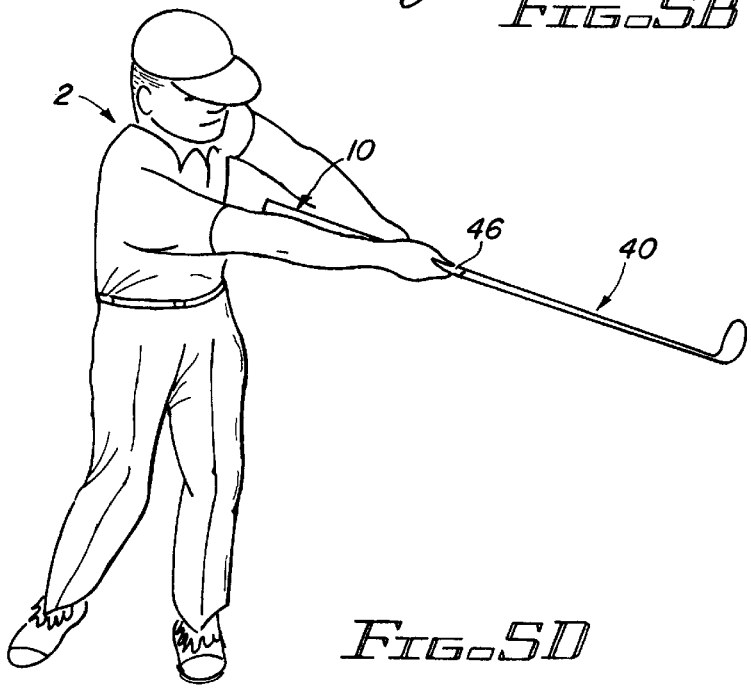
FIG. 5D

EXTENSION APPARATUS FOR GOLF CLUB

CROSS REFERENCE TO RELATED APPLICATION

This application is a Continuation In Part application of Ser. No. 08/968,038, which was filed on Nov. 12. 1997 now abandoned.

BACKGROUND OF THE INVENTION

1. Field of the Invention

This invention relates to golf clubs, and, more particularly, to an extension for a golf club for instructional purposes by a user while practicing chipping, pitching, and the like.

2.Description of the Prior Art

U.S. Pat. No. 1,557,156 (Gless) discloses an extension for a golf club, but the extension comprises a handle. That is, the golf club length is extended by an extension and the extension then becomes an integral part of the handle, with the grip at the outer end of the extension.

U.S. Pat. No. 1,565,070 (Edwards) discloses a two-part golf club.

U.S. Pat. No. 1,613,360, U.S. Pat. No. 1,634,082, and U.S. Pat. No. 1,634,887, all by the same inventor (Rigby) disclose shaft extensions for golf clubs. The grips are at the outer end of the extension elements. Essentially, the three patents disclose two-part golf clubs.

U.S. Pat. No. 1,895,369 (Blatz) discloses a telescoping shaft for golf club. The shaft includes a lock for the extension portion.

U.S. Pat. No. 3,516,697 (Hahn) discloses a connector for a two-piece golf club shaft.

U.S. Pat. No. 3,528,660 (Kategian) discloses a collapsible golf club shaft. The shaft is telescoping.

U.S. Pat. No. 3,539,185 (Andis) discloses a golf club having an adjustable length shaft. The patent discloses a wedge system which locks the grip relative to the rest of the shaft so that the grip does not twist in the user's hands.

U.S. Pat. No. 3,834,714 (Smolinski) discloses a golf club used for training and practice and which uses a spring to divide the grip into two portions. One portion of the grip is fixed to the shaft, and a second portion of the grip is rotatable and includes a coil spring connecting the removable grip with the shaft.

U.S. Pat. No. 3,933,378 (Sandford et al) discloses a quick connect coupling for a two-piece golf club shaft.

U.S. Pat. No. 4,429,875 (Stanton) discloses a two-part putter with specific coupling elements for connecting the two parts together.

U.S. Pat. No. 5,024,438 (Candow) discloses a golf putter extension to allow the golf putter to be used in a pendulum type manner.

U.S. Pat. No. 5,282,619 (Napolitano et al) discloses a practice golf club having three telescoping sections.

U.S. Pat. 5,390,921 (De Ruyter) discloses a tubular golf club shaft extension element. The grip is positioned at the outer end of the extension element. The extension simply makes a golf club shaft longer, with the grip at the outer end of the extension.

U.S. Pat. No. 5,649,870 (Harrison) discloses a golf club putter extension to enable the putter to be used with the pendulum type stroke.

The present invention includes an extension which fits onto the grip of a golf club shaft, but the extension does not change the original grip. The extension is to provide the user of the club to confirm that the user's pitching or chipping swing motion is correct. An incorrect swing motion will cause the extension to contact, or actually whack, the user in the side. If the swing motion is correct, the extension will not contact the user, but will move around the user's torso during the swing motion. A very simple locking system is used to lock the extension in place and allows the extension to be easily and speedily installed and removed from the golf club.

SUMMARY OF THE INVENTION

The invention described and claimed herein comprises an extension for a golf club and a locking system for locking the extension onto the outer end of the grip of a golf club. The extension includes a cup which fits over the end of the grip, and a tapered locking ring which moves upwardly on the grip and into the cup to lock the extension to the grip. The locking ring includes a slit to allow the locking ring to be put on and taken off the golf club. The cup on the extension allows the extension to be used with any make of golf club and any size grip. The slit ring is tapered to fit over the grip of any make and into the cup to provide a wedge action to lock the cup and thus the extension onto the grip of a golf club.

Among the objects of the present invention are the following:

- To provide new and useful golf club apparatus;
- To provide new and useful golf club apparatus having an extension for the grip portion of the shaft;
- To provide an extension for a golf club which includes a cup for receiving the end of the grip of the golf club and a locking ring to secure the extension onto the grip;
- To provide new and useful extension apparatus for a golf club for practice chipping and pitching motion; and
- To provide new and useful golf club extension apparatus having a cup for receiving the end of a grip and a slotted lock ring for locking the cup of the extension onto the grip of the golf club.

BRIEF DESCRIPTION OF THE DRAWING

FIGS. 5A and 5B sequentially illustrate the employment of the present invention as a training aid during the swing of a user.

FIG. 5C sequentially follows FIG. 5B but illustrating the employment of the apparatus of the present invention in an improper swing.

FIG. 5D sequentially follows FIG. 5C and illustrates the employment of the apparatus of the present invention in a proper swing.

DESCRIPTION OF THE PREFERRED EMBODIMENT

Figure 1:
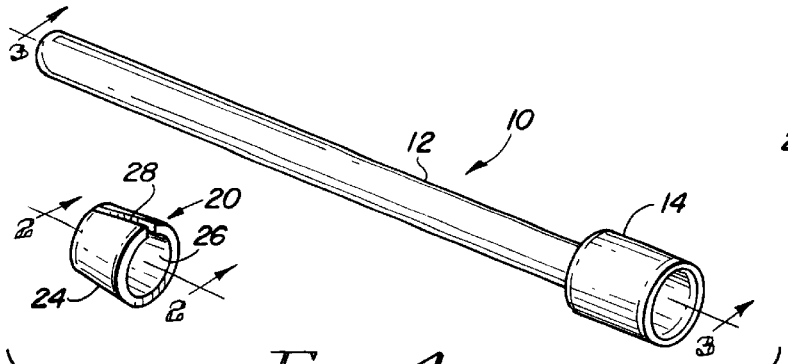
FIG. 1 is a perspective view of the apparatus of the present invention.
Figure 2:
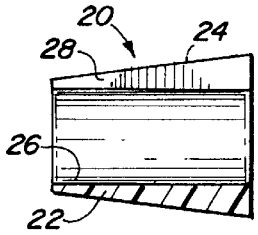
FIG. 2 is a view in partial section taken generally along line 2—2 of FIG. 1.
Figure 3:
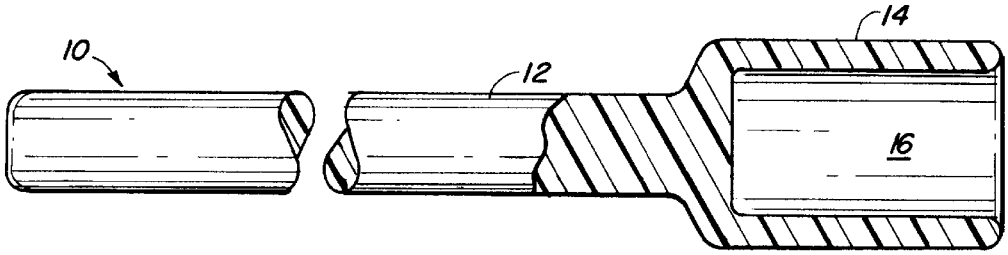
FIG. 3 is a view in partial section taken generally along line 3—3 of FIG. 1.

FIG. 1 is as exploded perspective view of extension apparatus 10 of the present invention. The invention includes a bar 12 and a lock ring 20. FIG. 2 is a view in partial section taken generally along line 2—2 of FIG. 1 showing the lock ring 20 in partial section. FIG. 3 is a view taken generally along line 3—3 of FIG. 1 showing the bar 12 in partial section. For the following discussion, reference will primarily be made to FIGS. 1, 2, and 3.

Figure 4A:
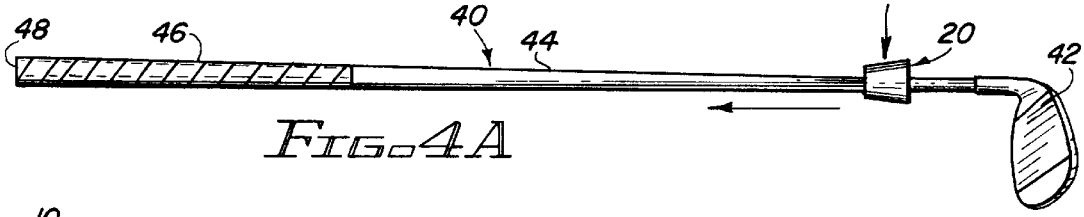
FIGS. 4A, 4B, 4C, and 4D sequentially illustrate the securing of the apparatus of the present invention to a golf club shaft.

Golf club extension apparatus 10 includes the bar 12 and the lock ring 20 which is used to secure the bar 12 to a golf club, such as a golf club 40 illustrated in FIG. 4A.

The bar 12 includes an enlarged diameter portion 14 which comprises a socket or connector portion. Within the socket 14 is a bore 16. The socket 14 receives the end of a golf club grip, as is illustrated below and as will be discussed in detail below. The size of the bore 16 is sufficiently large to receive a grip of virtually any size.

The lock ring 20 comprises a cylinder 22 having a tapered outside configuration 24 along the full length of the cylinder, and a bore 26 extends longitudinally through a cylinder 22. A slit 28 extends longitudinally through the cylinder 22 for the full length of the cylinder. The purpose of the slit 28 is to allow the lock ring 20 to be disposed on the shaft of a golf club by spreading the lock ring apart at the slit to receive a golf club shaft. With the full length longitudinal slit 28, the lock ring 20 may be placed on a shaft of virtually any size.

The purpose of the outside taper 24 of the cylinder 22 of the lock ring is to allow the apparatus 10 to be used with a golf club of virtually any grip diameter. The lock ring 20 secures the bar 12 to a golf club, as best illustrated in FIGS. 4B, 4C, and 4D, by cooperating with the bore 16 of the socket 14.

FIG. 4A is a side view of a golf club 40 showing a head 42, a shaft 44, and a grip 46 on the end of the shaft 44 remote from the head 42. The grip 46 includes an end 48. FIGS. 4B, 4C, and 4D, sequentially illustrate the securing of the apparatus 10 to the grip 46 of the golf club 40. In FIG. 4A, the lock ring 20 is shown disposed over the shaft 44. This is accomplished simply by spreading a lock ring 20 apart at the slit 28 and pushing the shaft 44 through the slit 28. The lock ring 20 is preferably made of an elastomeric material which has inherent flexibility or springiness which allows the lock ring 20 to open up as wide as necessary at the slit 28 to receive the shaft 44. For convenience, the lock ring 20 is typically installed on the shaft 44 between the grip 46 and the head 42.

Figure 4B:
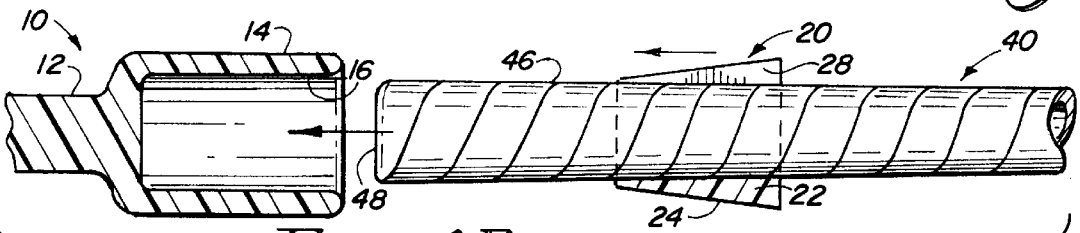

In FIG. 4B, the end 48 of the grip 46 is spaced apart slightly away from bore 16 of the socket or connector portion 14. The two large arrows indicate the direction of movement of the golf club 40 relative to the extension apparatus 10, and specifically of the grip 46 relative to the bore 16 and the movement of the lock ring 20 on the grip 46.

Figure 4C:
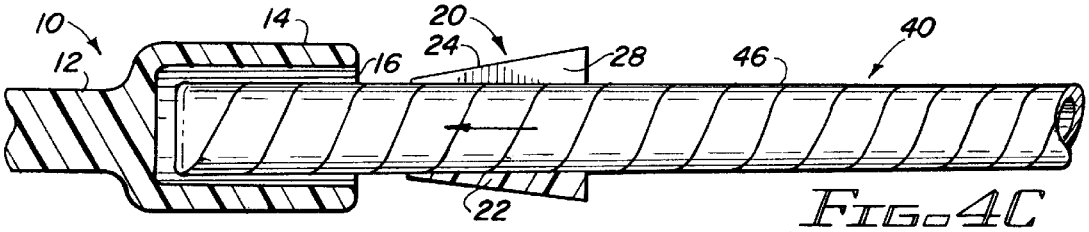
Figure 4D:
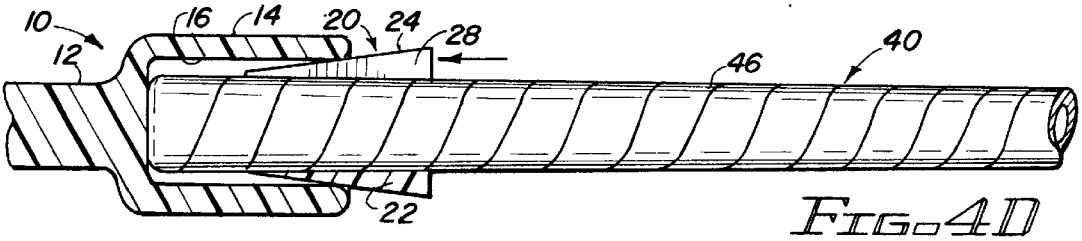

With the end 48 and the outer portion of the grip 46 moving into the socket 16, as sequentially illustrated in FIGS. 4C and 4D, the lock ring 20 is moved upwardly until the tapered outside configuration 24 is used as a wedge to securely lock the extension apparatus 10 onto the golf club 40. This final locking arrangement is illustrated in FIG. 4D.

The use environment and operation of the extension apparatus 10 is illustrated in FIGS. 5A, 5B, 5C, and 5D. FIGS. 5A, 5B, 5C, and 5D sequentially illustrates the employment of the extension apparatus 10 relative to a golfer 2. FIGS. 5A and 5B illustrate sequentially the swinging movement of the golfer 2, while FIG. 5C illustrates an improper swing, while FIG. 5D illustrates a proper swing.

For purposes of illustrating the apparatus 10 on the golf club 40 relative to the user 2, the user 2 is illustrated as being a right handed golfer, and the user's arms and left side are illustrated. The golfer 2 includes a right arm 4 with a right hand 5, a left arm 6 with a left hand 7, and a left side 8. In FIG. 5A, the user's swing is partway through, with the user's hands 5 and 7 properly holding the grip 46 of the golf club 40. FIG. 5B sequentially illustrates the movement of the golf club 40 as the head 42 approaches the golf ball.

An improper swing motion by the golfer 2 is shown in FIG. 5C, with the extension 12 contacting, or whacking, the side 8 of the golfer. However, in FIG. 5D, a proper swing is illustrated, with the extension 10 moving between the user's arms and the user's torso, and well away from the side 8 and the user's chest 9. Thus, the apparatus 10 is used to train a golfer to swing properly during pitching and chipping shots. An improper swing will result in the golfer getting whacked on the side, while the apparatus 10 will pass harmlessly in front of the golfer during a proper swing. Obviously, the length of the bar 12 may vary according to the size of the user, but the apparatus 10 will fit virtually any size golf club due to the tapered configuration of the lock ring 20. It will be noted that the socket 14 fits over only the outer end of the grip 46, as best shown in FIG. 4D. Accordingly, the user or golfer maintains the normal hand placement on the grip 46 while using the apparatus 10.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted to specific environments and operative requirements without departing from those principles. The appended claims are intended to cover and embrace any and all such modifications, within the limits only of the true spirit and scope of the invention.

What I claim is:

1. Extension apparatus for golf clubs having shafts and grips of different sizes on the shafts comprising in combination:

an extension bar;

an enlarged portion on the extension bar and a socket in the enlarged portion for receiving a portion of a grip; and lock ring means disposed about the grip and extendible into the socket for securing the extension bar on to grips of various sizes, including a lock ring, and a full length axial slit on the lock ring whereby the lock ring may be spread apart at the slit to allow the lock ring to be disposed on and removed from the golf club shaft.

2. The apparatus of claim 1 in which the lock ring means further includes a tapered outside to allow the bar and the socket to be secured to golf club grips of different sizes.

3. A method of training a golfer to swing properly for chipping and pitching comprising in combination the steps of providing a golf club having a head, a shaft, and a grip;

providing an extension for the golf club;

providing an enlarged diameter portion on the extension;

providing a socket on the enlarged diameter portion for receiving grips of different sizes;

providing a tapered lock ring to secure the extension to the grip whereby an improper swing will cause the extension to contact the user's body while a proper swing will allow the extension to pass between the user's arms and torso without contacting the user's body; and providing a full length axial slit on the ring whereby the ring may be spaced apart and disposed on the grip of the golf club.

4. The method of claim 3 in which the step of securing the extension to the grip further includes the steps of disposing the lock ring on the shaft, moving the lock ring on the shaft and on the grip, and inserting the lock ring on the grip and into the socket to lock the socket and extension on to the grip of the golf club.

* * * * *